US005141108A

United States Patent [19]

Roccaforte

[11] Patent Number: 5,141,108

[45] Date of Patent: Aug. 25, 1992

[54] CORE RETAINING CARTON

[75] Inventor: Harry I. Roccaforte, Western Springs, Ill.

[73] Assignee: Waldorf Corporation, St. Paul, Minn.

[21] Appl. No.: 607,123

[22] Filed: Oct. 31, 1990

[51] Int. Cl.[5] ..... B65D 85/672

[52] U.S. Cl. ..... 206/396; 206/397; 206/408

[58] Field of Search ..... 206/395, 396, 397, 408, 206/416

[56] References Cited

U.S. PATENT DOCUMENTS

| | | | |
|---|---|---|---|
| 2,743,009 | 4/1956 | Williamson et al. . | |
| 2,803,339 | 8/1957 | Kuchenbecker | 206/396 |
| 2,935,192 | 5/1960 | Million-Czarnecki . | |
| 3,229,812 | 1/1966 | Metzger | 206/408 |
| 3,246,742 | 4/1966 | Coe . | |
| 3,613,973 | 10/1971 | Jaeschke | 206/395 |
| 4,298,123 | 11/1981 | Roccaforte et al. . | |
| 4,813,539 | 3/1989 | Church et al. . | |
| 4,967,911 | 11/1990 | Lo Duca | 206/395 |

*Primary Examiner*—David T. Fidei
*Attorney, Agent, or Firm*—Dorsey & Whitney

[57] ABSTRACT

A carton for containing a product wound on a hollow core is provided. The carton has end walls at least one of which forms a core retainer comprising an inner wall having a tab foldably attached thereto for deflection into the carton interior and an overlapping wall coupled to a second side of the carton having a second tab foldably attached thereto and deflectable toward the carton interior, whereby the two tabs cooperate upon deflection to form a V-shaped retaining member in the carton interior to hold the core in place as product is removed. An outer end wall foldably attached to a third side of the carton overlaps the first two walls to close the end of the carton. The invention also encompasses a flat blank for forming into the package.

16 Claims, 4 Drawing Sheets

CORE RETAINING CARTON

The present invention relates to dispensing packages for containing and dispensing products of the type wound around a hollow core. More particularly, the present invention relates to a package which facilitates the use of such products by retaining and supporting the roll of product in the package as the core rotates and portions of the product are removed.

BACKGROUND OF THE INVENTION

The present invention is an improvement related to the carton with core retainers disclosed in U.S. Pat. No. 4,298,123, owned by the assignee of the present invention.

The '123 patent is directed to overcoming the tendency of an entire product roll to come out of the box when a portion of the product on the roll is being dispensed. Core retainers, projections integrally formed with the carton and the overlapping ends walls thereof, are located at each end of the box to project inside the core after the carton is erected and filled. The projecting retainers are designed to resist the rolled product's tendency to be pulled or removed entirely from the carton as force is applied to the product to remove a portion thereof from the carton.

The '123 patent is also directed to a carton blank for forming a carton having core retainers therein comprising top, bottom, front and back side panels integrally formed with and hingedly attached to each other, an inner wall having an orifice and hingedly connected to each end of one of said side panels, an overlapping wall having a projection and hingedly connected to each end of a second one of said side panels, and an outer wall connected to each end of a third one of said side panels, whereby when the blank is folded and erected with the product on a hollow core contained therein, the inner wall, overlapping wall and outer wall on each end are folded into overlying relation to form a composite end wall of the carton with the projections retaining the core in place in the carton.

Although the '123 patent represents a significant improvement in packaging for rolled products, there are some problems that patent does not address. One such problem relates to economics of production and, specifically, to the need for a package that minimizes the expenses in manufacturing and erecting a carton having retainers for retaining rolled products. Cartons such as the '123 carton are relatively expensive to make because they require numerous and complex die-cuts and removal of portions of at least two flaps used in each end wall of the carton.

A related problem not addressed by the core retainers disclosed in the '123 patent, nor those suggested in U.S. Pat. No. 4,813,539, is that the inward folding or deflection of the tabs or members forming the core retaining projections can pose manufacturing difficulties, because it must be accomplished within relatively strict tolerances. If the projections are deflected or folded inwardly too far, they or the carton may be torn or will fail to engage to perform their function.

Other issues that have been unsatisfactorily unaddressed in the art are the need for optimizing locking performance of the projections or tabs forming the core retainers and the need for a simpler projection engagement mechanism whereby there is a reduced risk that the carton and core retainer structure will be torn during erection, filling and shipping of the carton containing the product. Additionally, it is desirable to reduce the amount of paperboard used for fabricating a carton, just as, in the interest of economy, the number of machining steps for preparing the carton blank should be reduced. Simply put, with current core retaining packages, efficiency, performance and durability are not enhanced to an optimum degree.

Accordingly, there is a need for a simple, strong, efficient, disposable paperboard package with core retainers for containing and dispensing roll-type materials.

SUMMARY OF THE INVENTION

In accordance with the present invention, an improved core retaining package for containing and retaining a product in roll form while the product is being dispensed or extracted is provided. The product may be of the type comprising a endless sheet of material wound upon a hollow tubular core or rolled upon itself to form a hollow core. The carton has end walls, at least one of which has a core retainer comprising an inner wall coupled to a first side of the carton and having a first tab foldably attached thereto for deflection into the carton interior and an overlapping wall coupled to a second side of the carton having a second tab foldably attached thereto and deflectable toward the carton interior, whereby the first and second tabs cooperate upon deflection to form a V-shaped retaining member in the carton interior to hold the core in place in the carton. An outer wall is foldably attached to another side of the carton for overlapping the first two walls and closing the end of the carton. The invention also encompasses a flat blank for forming into the package.

An important objective of the present invention is to provide a carton for containing and dispensing products wound on a hollow core, whereby the cost/benefit ratio of carton manufacture is improved.

Another object of the present invention is to provide a package for containing and dispensing a product on a hollow core, whereby erection of the carton and, specifically, the core retaining portions is made more efficient and the core retaining portions are stronger.

An important advantage of the present invention is that it combines specific manufacturing advantages and dispensing advantages, whereby the manufacture becomes more cost effective and whereby point-of-use effectiveness of the package is improved.

Other advantages of the present invention are that it reduces consumption of valuable package making resources such as paperboard. It provides for more efficient, cost effective die cutting or forming of the blank, as well as erection of the carton. The improved core retaining package of the present invention provides for better locking engagement between the deflectable tabs and flaps or projections forming the core retainers. Additionally, the carton of the present invention easily may be adapted for use with different size rolls of the product.

Other objects and advantages of the present invention will become more fully apparent and understood with reference to the following specification and to the appended drawings and claims.

DETAILED DESCRIPTION OF THE PREFERRED EMBODIMENT

Figure 1:
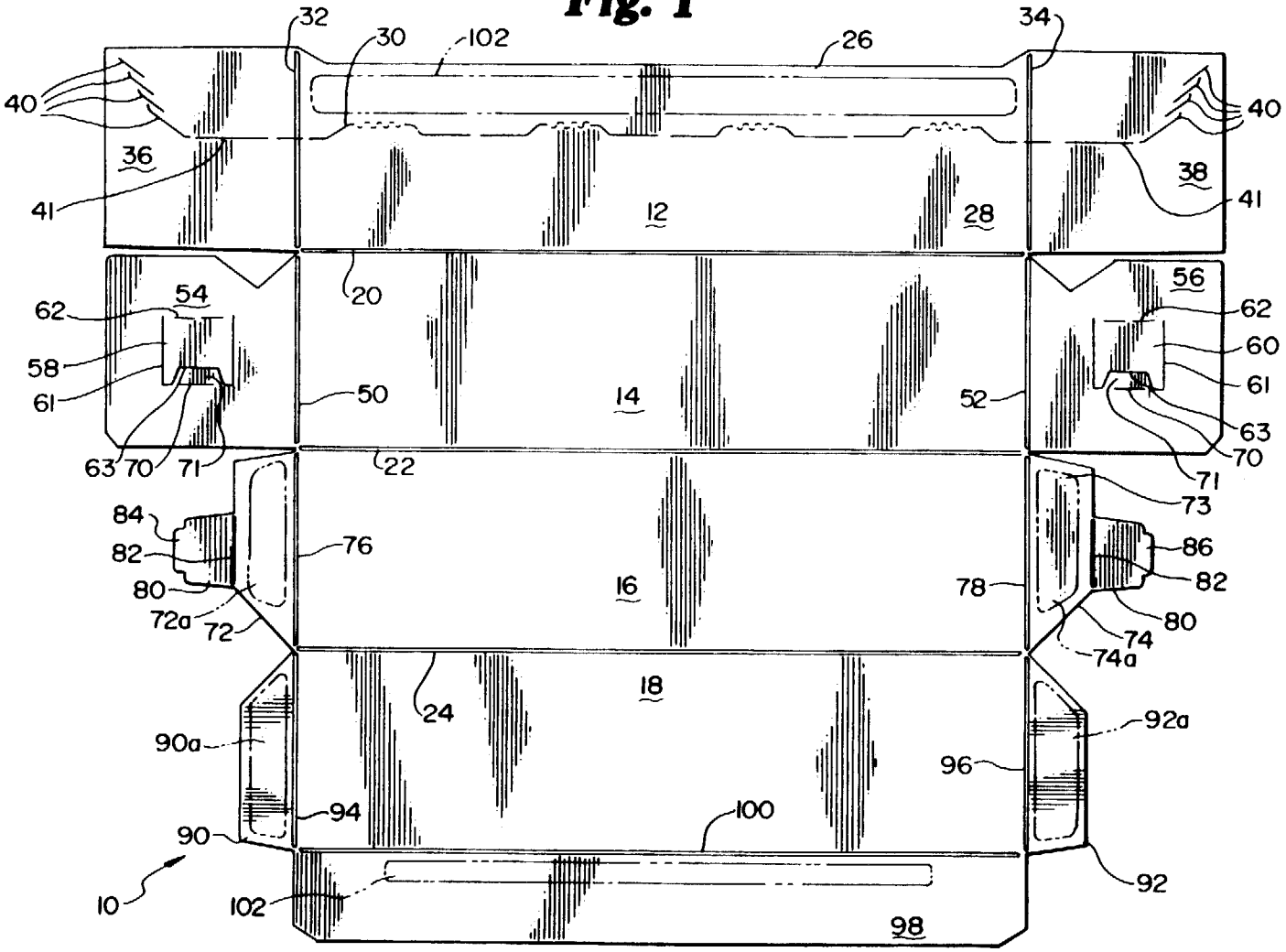
FIG. 1 is a top plan view of the blank from which the carton having the improved core retainers of the present invention may be formed and shows the die-cut profile thereof.

As shown in FIG. 1, the blank 10 in accordance with the present invention includes a front panel 12, a bottom panel 14, a rear panel 16 and a top panel 18. Panels 12, 14, 16 and 18 are integrally formed and consecutively, foldably connected to each other at parallel score lines 20, 22 and 24. The blank 10 is preferably made from a flexible, resilient material such as paperboard.

The front panel 12 includes a front upper portion 26 and a front lower portion 28. The portions 26, 28 are defined by the edges of the front panel 12 and separated by a breakaway line 30 extending across the longitudinal length of the front panel 12. At the opposed right and left ends of the front panel 12 (as seen in FIG. 1), opposed, parallel fold score lines 32 and 34 connect left and right outer end panels 36 and 38 to the front panel 12. Each outer end panel 36, 38 is provided with an angled breakaway line 41 formed by linear incisions extending to the center of each panel 36, 38 that are a continuation of the breakaway line 30 and a plurality of herringbone incisions 40 extending from each panel center diagonally to the outermost corner.

Inner end panels 54, 56 are integrally formed with and attached to the bottom panel 14, one panel 54, 56 being attached at each of the left and right ends of the bottom panel 14 at opposed, parallel fold score lines 50, 52. Each of the inner end panels 54, 56 include a hinged core tab portion 58, 60. The core tab portions 58, 60 are enabled and defined by a generally "W"-shaped incision or cut 61 in the central area of each of the inner end panels 58, 60. Each core tab 58, 60 is separable from its associated inner end panel 54, 56 along the incision profile 61 and is foldably attached to its associated panel 58, 60 along a foldline 62. Each foldline 62 comprises broken incisions, cuts or crease scores separated, from the upper tips of "W"-shaped incision 61, to aid folding, whereby the core tabs 58, 60 may be folded out of the plane of the inner end panels 54, 56. Note that when folded out of the plane of its corresponding inner end panel 54, 56, each core tab 58, 60 will have a resilient tendency causing it to move back into said plane. Parallel to the fold lines 62, and between the lower tips of the "W"-shaped incision 61 defining the tabs 58, 60, a portion of the incision 61 is straight and perpendicular with respect to the outer edge of each panel 54, 56. This straight portion, extending between the lower tips of "W"-shaped incision 61, simultaneously forms a notch 63 in each core tab 58, 60 and defines a small bias tab 71.

Each inner end panels 54, 56 also includes an incision or cut score 70 spanning between the lowermost tips of the "W"-shaped incision 61. This cut score 70 is parallel to that portion of the "W"-shaped incision 61 that defines the outer edge of bias tab 71. The cut score 70 forms a foldline for the bias tab 71.

Middle end panels 72, 74 are formed integrally with and foldably attached to the left and right ends of the rear panel 16 at opposed, parallel fold score lines 76, 78. The middle end panels 72, 74 are somewhat smaller than the other end panels 36, 38, 54, 56. Each middle end panel 72, 74 has a core-lock tab 80 extending in a direction perpendicular to the associated fold score line 76, 78 and foldably connected to its associated panel 72, 74 at a fold score line 82. Each core-lock tab 80 has a narrowed outermost brace tip 84, 86. The tips 84, 86 have rounded corners and are integrally formed with the foldable core-lock tabs 80. For reasons explained below, the outer edge configuration of each brace tip 84, 86 conforms in width to the notch 63 of the cut or incision 61 forming the core tabs 58, 60.

At each of the opposed left and right ends of top panel 18 is attached a hood panel 90, 92 at opposed parallel foldlines 94, 96. For reasons explained below, the upper edge of each hood panel 90, 92 is angle-cut at about forty-five degrees, or at some other suitable angle, in a manner complementary to the angle cut at the lower edge of each middle end panel 72, 74. Along the lower side edge of the top flap 18 (as seen in FIG. 1), opposed to the foldline 24, a major glue flap 98 is foldably attached along foldline 100.

The blank 10 of the present invention as shown in FIG. 1 has gluing or adhesive areas at appropriate locations thereon. The areas are shown in phantom on the opposite side of the blank 10 in FIG. 1. Each middle end flap 72, 74 has a glue area 72*a*, 74*a*. Each hood panel 90, 92 has a glue area 90*a*, 92*a*. Major glue flap 98 has a glue area 102.

Figure 2:
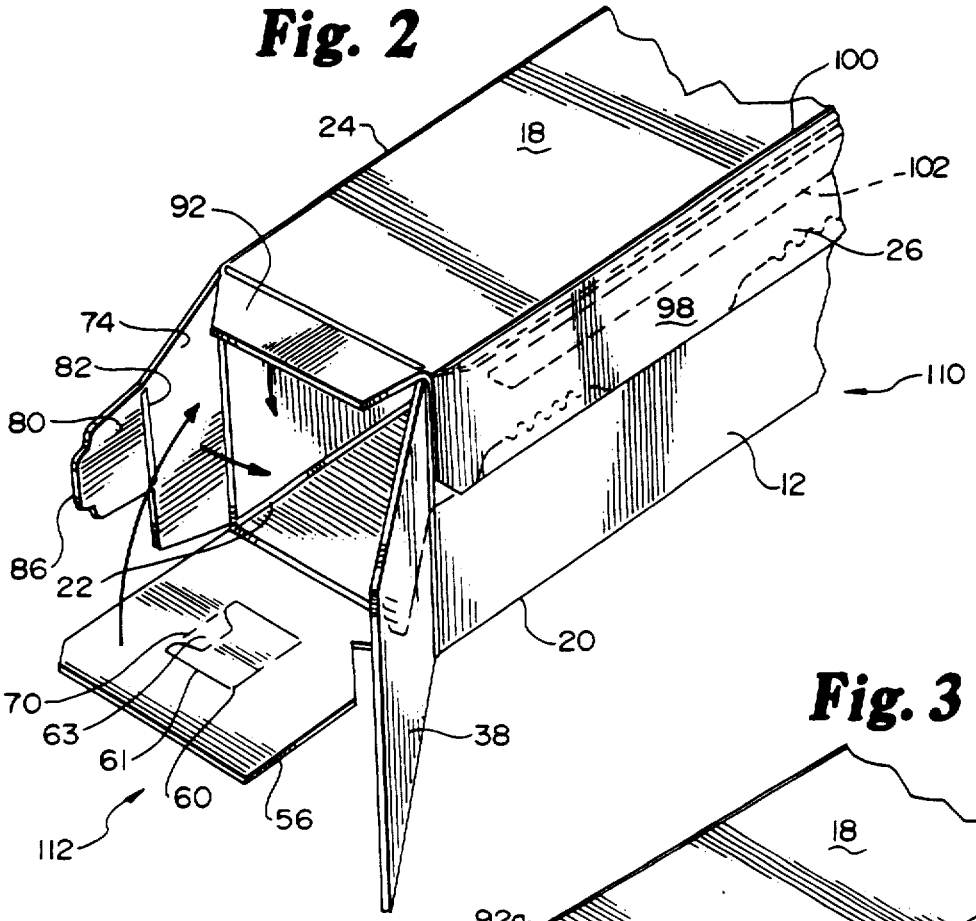
FIG. 2 is a fragmentary perspective view of the present invention depicting the beginning of the carton erection sequence.
Figure 3:
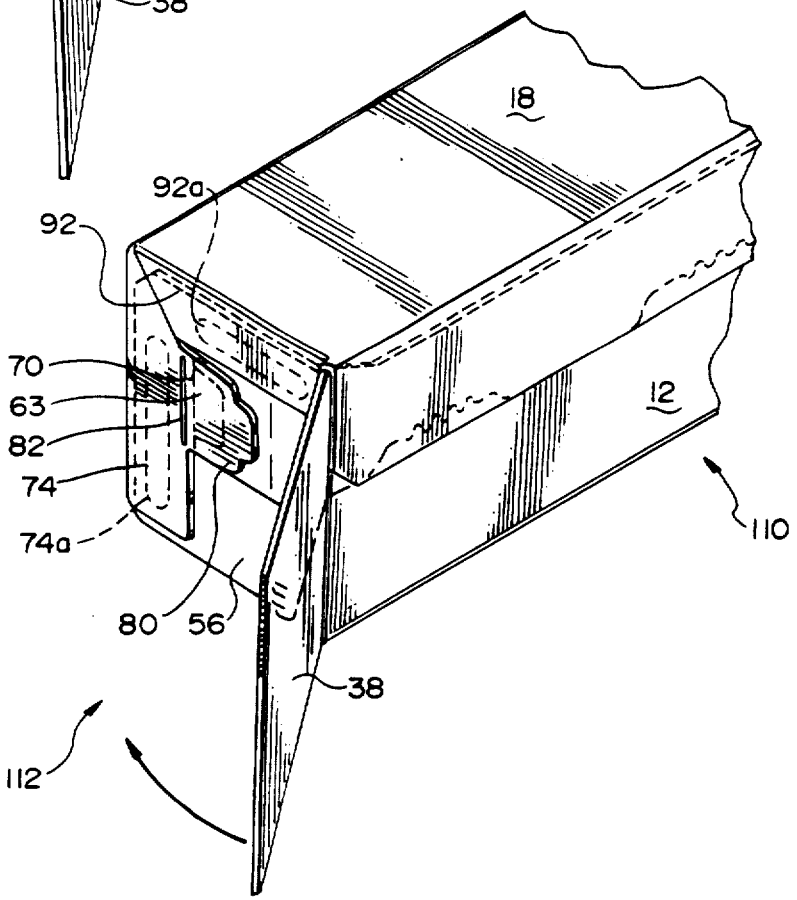
FIG. 3 is a fragmentary perspective view depicting the carton of the present invention partially erected.
Figure 4:
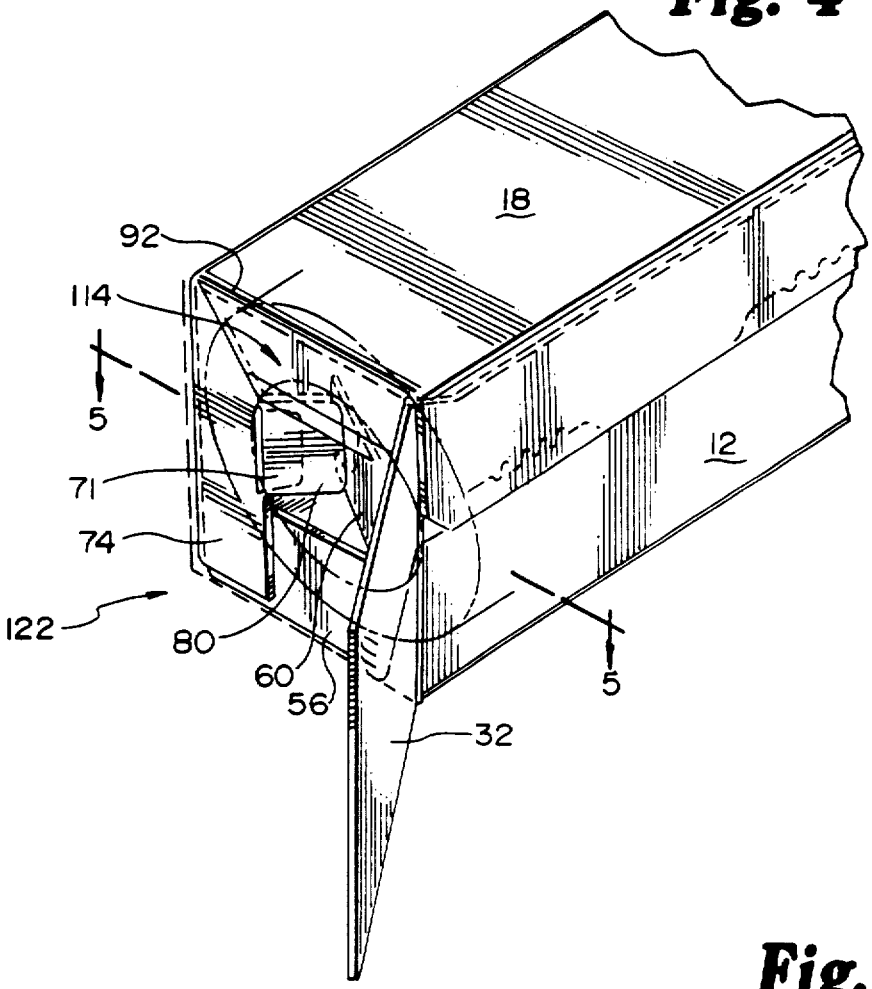
FIG. 4 is a fragmentary perspective view depicting the roll of product inserted in the carton and the carton positioned for final closure.
Figure 6:
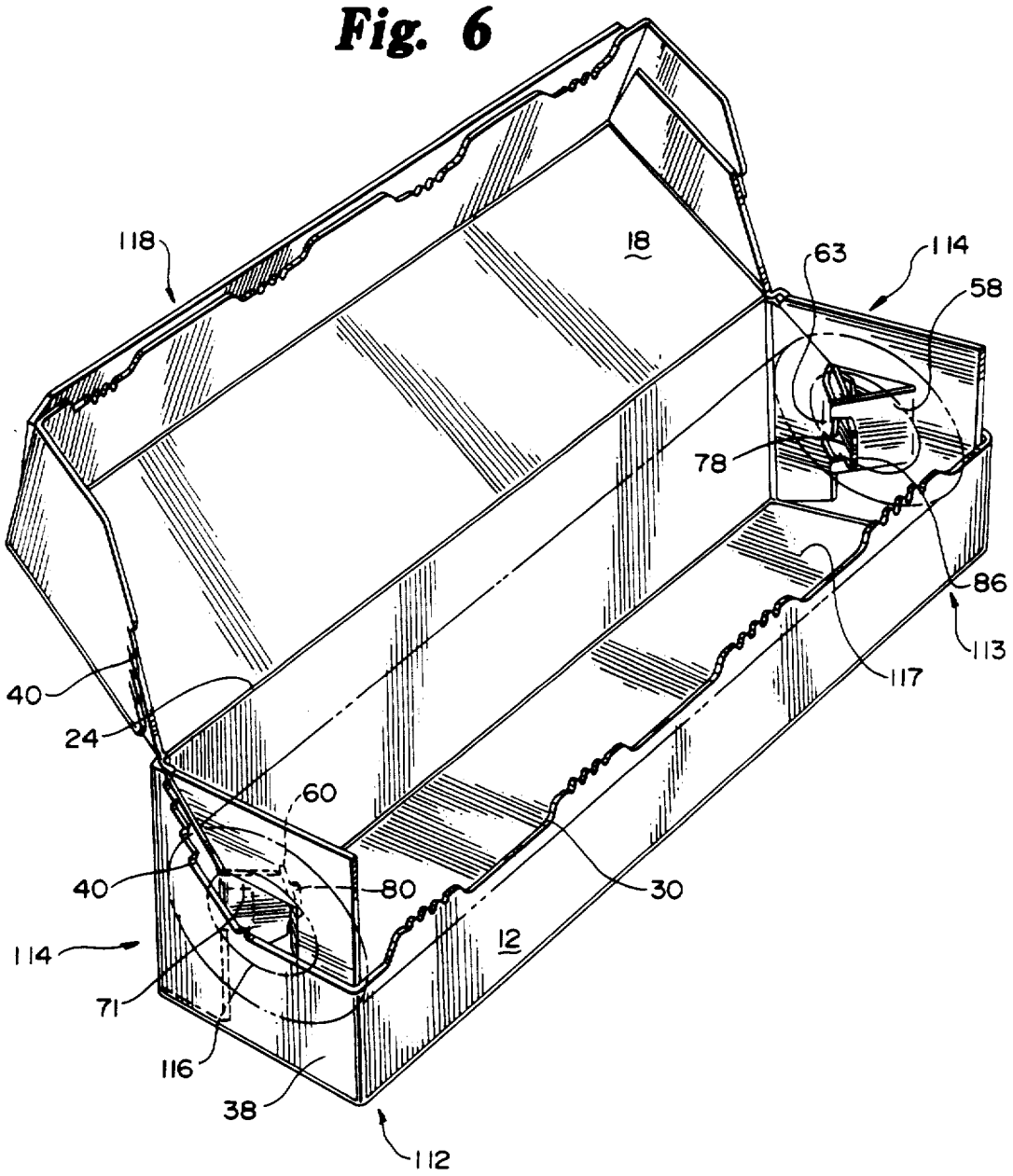
FIG. 6 is a perspective view of the present invention depicting the improved core retaining carton broken open with a roll of material depicted within the carton in phantom.

FIGS. 2, 3 and 4 show the folding sequence that is used to form end walls 112, 113 that appear in finished form in FIG. 6. Each end wall 112, 113 incorporates a core retainer or spindle structure 114 formed in accordance with the present invention. FIG. 2 is a partial perspective end view of the carton 110 formed from the blank 10 of the present invention. The blank 10, described hereinabove, has been folded, tubed and erected, specifically by right angle folds about foldlines 20, 22, 24 and 100, now forming the edges of a rectangular, box carton. The glue flap 98 has been affixed against front flap panel 12 and, more particularly, against the front upper panel 26 by glue at glue area 102.

At the point in the sequence of erection depicted in FIG. 2, a product wound upon a core may be placed inside the generally tubular shape of the carton 110. The ultimately closed end walls 112, 113 at the ends of the carton are comprised of various panels associated with each end. For end wall 112, the constituent panels are: outer end panel 38, inner end panel 56, middle end panel 74, and hood panel 92. The opposite end wall 113 of the carton (not shown in FIG. 2) is mirror-image identical (see FIG. 1) and is erected in the same sequence, thus only the end wall 112 of the carton 110 depicted in FIGS. 2-5. The panels making up the end wall 112 of the carton 110 depicted in FIG. 2 are ready for folding and gluing once the product has been placed in the carton 110.

FIG. 3 is a partial perspective end view of the carton 110 of the present invention wherein the carton end wall 112 has been partially closed. Specifically, inner end panel 56 has first been folded inwardly, followed by the hood panel 92 and then by the middle end panel 74. No adhesive or other interconnection has been made between the carton end panels at this point. As can be seen the forty-five degree angle-cuts of middle end panel 74 and hood panel 92 align closely. The outer end panel 38 is ready to be folded onto the other previously-folded panels, but first the core retainer 114 must be erected.

FIG. 4 depicts the erection of the core retainer 114 and one of the advantages of the present invention. Specifically, once the inner end wall 56 and the middle end wall 74 have been folded into overlying parallel relationship as depicted in FIG. 3, the core-lock tab 80 and the core tab 60 are indexed or pushed inwardly toward the carton interior by a rod or other suitable means (not shown) to form a core retainer 114 for the carton end 112. The core retainer 114 is formed when the core-lock tab 80 and the core tab 60 come together and, specifically, when the brace tip 86 of the core-lock tab 80 comes to rest in frictional engagement with the notch 63 of the "W"-shaped incision 61 forming the core tab 60. It should be appreciated that this occurs when the core tab 60 and core-lock tab 80 are deflected or pushed inwardly sufficiently far at the same time. This concurrent deflection is enabled because, as shown in FIG. 3, the core tab 60 and core-lock tab 80 substantially overlie and are generally congruent with one another when the middle end wall 74 and the inner end wall 56 are folded into overlying parallel relationship. The core-lock tab 80 is folded through the opening in the inner end wall 56 formed by the inward folding of the core tab 60. It is important to note that each of the core tab 60 and the core-lock tab 80 when folded inwardly on their respective parallel, opposed foldlines 62, 82 has a resilient tendency to return to the plane of the panel from which it was folded. This helps to drive the notch 63 and the brace tip 86 into frictional, locking engagement.

Figure 5:
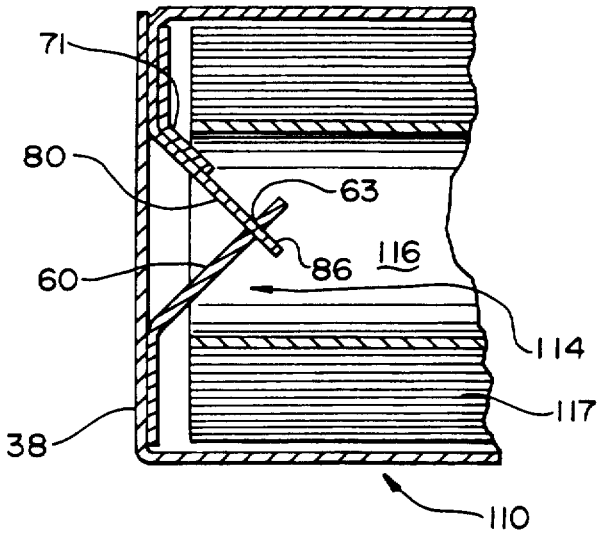
FIG. 5 is a fragmentary top plan section taken along line 5—5 of FIG. 4 depicting the core retaining carton fully assembled and filled.

FIGS. 4 and 5 show how further strength and stability are provided to the core retainer 114 by the bias tab 71. It should be noted that if sufficient resiliency and strength is provided by the core tab 60 and the core-lock tab 80, the area of the blank 10 forming the bias tab 71 may be stripped out. Typically, the bias tab 71 is folded inwardly behind core-lock tab 80. Like the core tab 60 and core-lock tab 80, the inwardly folded bias tab 71 has a resilient tendency causing it to be urged in the direction of the plane of inner end wall panel 56. This resilience enhances the resilient tendency of core-lock tab 80 and biases the core-lock tab 80 outwardly to fasten more securely the brace tip 86 in the notch 63 and lock the core retainer 114 in place. The foldline 70 and the foldline 82 lie parallel to and adjacent each other.

FIG. 5 is a sectional view taken along lines 5—5 of FIG. 4 and depicts the core retainer 114 extending into a core 116 of product roll 117 contained in the carton 110. FIG. 5 also shows that after the folding of the end panels 56, 74 and 92 and the inward deflection of the core retainer 114 components, specifically core tab 60 and core-lock tab 80, the outer end wall 38 is folded into overlying relationship to close the end of the carton 110. The outer wall 38 is secured in place by glue placed at the glue areas **74*a*, 92*a* shown in FIG. 1**.

FIG. 6 is a perspective view of a completed, glued, filled carton 110 in its open state with a roll of product 117 contained therein and shown in phantom. The carton has been opened along the breakaway line 30 and the extensions of that line comprising curved breakaway lines 41 extending across the outer end panels 36, 38. The hood or cover 118 of the carton 110 thus formed may be pivoted open and closed along fold line 24.

To dispense the product 117, which might be a roll of material with perforations for separating portions for use (e.g., fabric softener sheets), the exposed edge of the product roll 117 may be grasped and as it is being dispensed, the core 116 and rolled product 117 will rotate within the carton 110 while being supported and held in place by the core retainers 114. The carton may then be reclosed by pivoting the hood 118 about the foldline 24.

Important commercial advantages of the present invention include that the core retainers 114 may be erected with substantially less mechanical tolerance and supervision required for deflecting or pushing their components inwardly. That is, almost any retractable rod or other indexing device (not shown) may be used to push the core tab 60 and core-lock tab 80 inwardly; the extent of their travel inwardly does not have to be controlled or supervised rigorously. The reason is that the cooperating notches 63 and brace tips 84, 86 spring together automatically as the indexing rod is withdrawn. The bias tab 71 serves to bias the core-lock tab 80 outwardly into place against the notch 63, also further strengthening the core retainer 114.

A number of variations of the present invention can be made. For example, the carton 110 may be made in various sizes to provide a rolled product receiving cavity that can accommodate different size rolls of product 117. The paperboard from which the present invention is fabicated may be of any suitable composition and may be coated with appropriate substances to import desirable characteristics, such as resistance to liquids. Various methods might be used to hold the carton ends in the closed position depicted in FIGS. 2–4. Such methods might include the use of appropriate adhesives or include systems of interlocking tabs. The rectangular cross section of the carton 110 is convenient, but all that is necessary is that the various end panels be foldable in the appropriate juxtaposition and other cross-section could also be used. The interlocking of core-lock tab 80 and notch 63 may take other forms, such as multiple tabs and mating notches or other interengaging edges that provide a frictional interlock. The carton 110 may be overwrapped with appropriate thermoplastic sheet material or other suitable material and both the interior and exterior of the completed carton 110 or the blank 10 may be marked with appropriate indicia.

What is claimed is:

1. A carton for containing and dispensing a product rolled around a hollow core, said carton having at least one core-retaining end wall comprising:

a first end wall panel having therein a first tab cut into the interior of said first end wall panel so as to be resiliently foldable on a first foldline into the interior of the carton, leaving an opening in said first end wall panel, said first tab having a free edge opposite the first foldline; and a second end wall panel having a second tab extending therefrom, said second end wall panel overlying the first end wall panel when the core-retaining end wall is erected so that the second tab is resiliently foldable on a second foldline substantially parallel to and opposite said first foldline to extend through the opening in said first end wall panel into the interior of the carton, said second tab having thereon means for frictionally engaging the free edge of the first tab to lock both said first and second tabs into a configuration projecting into the interior of said carton to engage the hollow core of the product.

2. The carton of claim 1 further comprising a third end wall panel, said third end wall panel overlying and connected to at least one of said first and second end wall panels to hold said first, second and third end wall panels in overlying configuration when the core-retaining end wall is erected.

3. The carton of claim 1 wherein the first tab comprises a core tab having a notch at its free edge and said second tab comprises a core-lock tab having a brace tip that frictionally engages the notch.

4. A carton for containing and dispensing a product rolled around a hollow core, said carton having at least one core-retaining end wall comprising:

a first end wall panel having therein a first tab cut into the interior of said first end wall panel so as to be resiliently foldable on a first foldline into the interior of the carton, leaving an opening in said first end wall; and a second end wall panel having a second tab extending therefrom, said second end wall panel overlying the first end wall panel so that the second tab is resiliently foldable on a second foldline substantially parallel to and opposite said first foldline through the opening in said first end wall panel into the interior of the carton, said second tab having thereon means for frictionally engaging the first tab to lock both said first and second tabs into a configuration projecting into the interior of said carton to engage the hollow core of the product, wherein the first end wall panel further comprises a bias tab resiliently foldable on a third foldline substantially parallel to and adjacent to the second foldline, said bias tab engaging the second tab when it is resiliently folded into the opening of the first end wall panel to enhance the resilient tendency of the second tab and increase its frictional engagement of the first tab.

5. The carton of claim 1 wherein the first and second panels are connected to adjacent sides of a carton that form a right angle between them.

6. The carton of claim 5 wherein the carton is a tubular carton having a rectangular cross-section.

7. A carton for containing and dispensing a product on a hollow core, said carton having at least one core-retaining end wall comprising:

an inner end panel foldably connected to a first side of the carton and including a projectable, generally central tab with a free edge oriented substantially perpendicular to the foldable connection of the central tab to the first side;

a first overlapping end panel foldably connected to a second side of the carton, said first overlapping end panel overlapping the inner end panel in an area between the second side of the carton and the central tab upon erection of the core-retaining end wall;

a second overlapping end panel foldably connected to a third side of the carton and including a second tab foldably connected to the second overlapping panel with a free edge opposite the foldable connection of the second tab to the second overlapping end panel;

a V-shaped projection extending into said core, said projection formed upon erection of the core-retaining end wall by said central tab and said second tab and including locking means for locking together the free edges of the central tab and the second tab; and an outer end panel foldably connected to a fourth side of the carton and overlying at least a portion of the other end panels upon erection of the core-retaining end wall.

8. The carton according to claim 7, wherein the locking means comprises a notch formed on the free edge of said central tab and a tip extending from the free edge of the second tab, said tip and notch having complementary configurations whereby the tip fits closely within the notch.

9. A carton for containing and dispensing a product on a hollow core, said carton having at least one core-retaining end wall comprising;

an inner end panel foldably connected to a first side of the carton and including a projectable, generally central tab;

a first overlapping end panel foldably connected to a second side of the carton and overlapping the inner end panel in an area between the second side of the carton and the central tab;

a second overlapping end panel foldably connected to a third side of the carton and including a second tab foldably connected to the second overlapping panel;

a V-shaped projection extending into said core, said projection formed by said central tab and said second tab and including locking means for locking together the central tab and the second tab, wherein the locking means further comprises a notch formed on said central tab at the edge of the tab opposite the edge at which the tab is foldably connect to the inner end panel and a tip extending from the edge of the second tab opposite the edge at which the tab is foldably connected to the major overlapping end panel, said tip and notch having complementary configurations whereby the tip fits closely within the notch and wherein the locking means includes a bias means for urging the tip into the notch; and an outer end wall foldably connected to a fourth side of the carton and overlying at least a portion of the other end walls.

10. The carton according to claim 9, wherein the carton has two opposed end walls, each of the walls having a core retainer.

11. A flat blank for forming a carton for containing and dispensing a product wound on a hollow core, comprising:

generally rectangular front, bottom, rear and top panels, the front panel foldably connected to the bottom panel along one side thereof, the rear panel foldably connected to the bottom panel along an opposite side thereof, the top panel foldably connected to the rear panel along an opposite side thereof and having a gluing flap foldably connected along an opposite side;

outer end panels foldably connected to opposite end edges of the front panel;

inner end panels foldably connected to the opposite end edges of the bottom panel and having a generally central first tab foldably connected within the interior of each inner end panel, said first tab having a free edge opposite its foldable connection to the inner end panel;

middle end panels foldably connected to the opposite end edges of the rear panel, said middle end panels extending substantially along their foldable connection to the rear panel and outwardly therefrom for a distance substantially equal to the distance between the foldable connection between the bottom panel and the inner end panel and the nearest parallel edge of the generally central first tab, said middle end panels having a second tab foldably connected thereto, said second tab having thereon means for lockably engaging the free edge of the first tab; and hood panels foldably connected to the opposite end edges of the top panel and extending therefrom a distance substantially equal to the distance said middle end panels extend from said rear panel.

12. The blank according to claim 11, wherein said front panel and said outer end panels include a plurality of in-line incisions comprising a tear line.

13. The blank according to claim 12, wherein adhesive areas are provided on said front panel between the free edge thereof and the line of incisions, on the hood panels and on the middle end panels, whereby when the blank is folded into a generally closed tubular configuration, the front panel adhesive area is between the front panel and the glue flap and the adhesive areas on the hood panels and the middle end panels are between the hood panels and the middle end panels and the outer end panels.

14. The blank according to claim 13, wherein, when the blank is folded into a generally closed tubular carton having a central product receiving cavity with said end walls in overlying relation, the first tab and the second tab may be folded inwardly and locked together thereby forming a projection extending into the cavity.

15. A multi-layered end closure for generally tubular, hooded cartons for containing and dispensing products having a hollow central core, said end closure comprising:

an inner end wall foldably connected to a first side of the carton and including a projectable, generally central core tab;

an overlapping end wall foldably connected to a second side of the carton and overlapping the inner wall in an area between the second side of the carton and the core tab;

a middle end wall foldably connected to a third side of the carton and including a second tab foldably connected thereto, whereby when the middle wall overlaps the inner wall, the central core tab is substantially beneath the second tab, whereby a projection is formed in the interior of the carton when the core tab and second tab are folded inwardly, at opposed, spaced, parallel fold lines, so that each has an inwardly projecting innermost free edge;

locking means for locking together the core tab and the second tab after the projection is formed, said locking means comprising a notch formed at the innermost free edge of one of said core tab and said second tab and means for frictionally engaging said notch formed on the innermost free edge of the other tab; and an outer end wall foldably connected to a fourth side of the carton and overlying at least a portion of the other end walls.

16. The end closure according to claim 15, wherein the projection is generally triangularly shaped in cross-section and comprises a base formed by a plane containing the inner end wall, two sides, one formed by the core tab deflected out of said plane and the second by the second tab deflected out of the plane of the middle end wall, and an apex formed by the intersection of the core tab and the second tab.

* * * * *